United States Patent [19]

Weatherspoon

[11] Patent Number: 4,813,676

[45] Date of Patent: Mar. 21, 1989

[54] LOTTERY NUMBER SELECTION DEVICE

[76] Inventor: Wallace Weatherspoon, 19622 Ray Cir., Cerritos, Calif. 90701

[21] Appl. No.: 129,545

[22] Filed: Dec. 7, 1987

[51] Int. Cl.[4] ..... A63F 9/00

[52] U.S. Cl. ..... 273/144 A; 366/193; 366/195

[58] Field of Search ..... 273/144 A; 366/192–196

[56] References Cited

U.S. PATENT DOCUMENTS 547,263 10/1895 Hoyle ..... 366/193
2,003,979 6/1935 Skoric ..... 273/144 A
3,140,875 7/1964 Abbott et al. ..... 273/144 B

FOREIGN PATENT DOCUMENTS 553477 6/1932 Fed. Rep. of Germany ... 273/144 A
2346779 10/1977 France ..... 273/144 A

*Primary Examiner*—Paul E. Shapiro
*Attorney, Agent, or Firm*—Charles H. Thomas

[57] ABSTRACT

An apparatus for selecting lottery balls each bearing a unique lottery indicia is comprised of a hollow, spherical globe within which an arcuate carrier is turned by a crank. The outwardly facing surface of the carrier follows the contour of the interior surface of the globe and has a radially outwardly directed tripping tooth. A sliding hatch is disposed at the lowest extremity of the globe to move reciprocally to block and unblock a lottery ball outlet. A tang extending radially inwardly from the sliding hatch is engaged by the tripping tooth to open the lottery ball outlet to dispense a lottery ball therefrom. The hatch may be selectively locked to block the lottery ball outlet.

12 Claims, 2 Drawing Sheets

FIG. 1
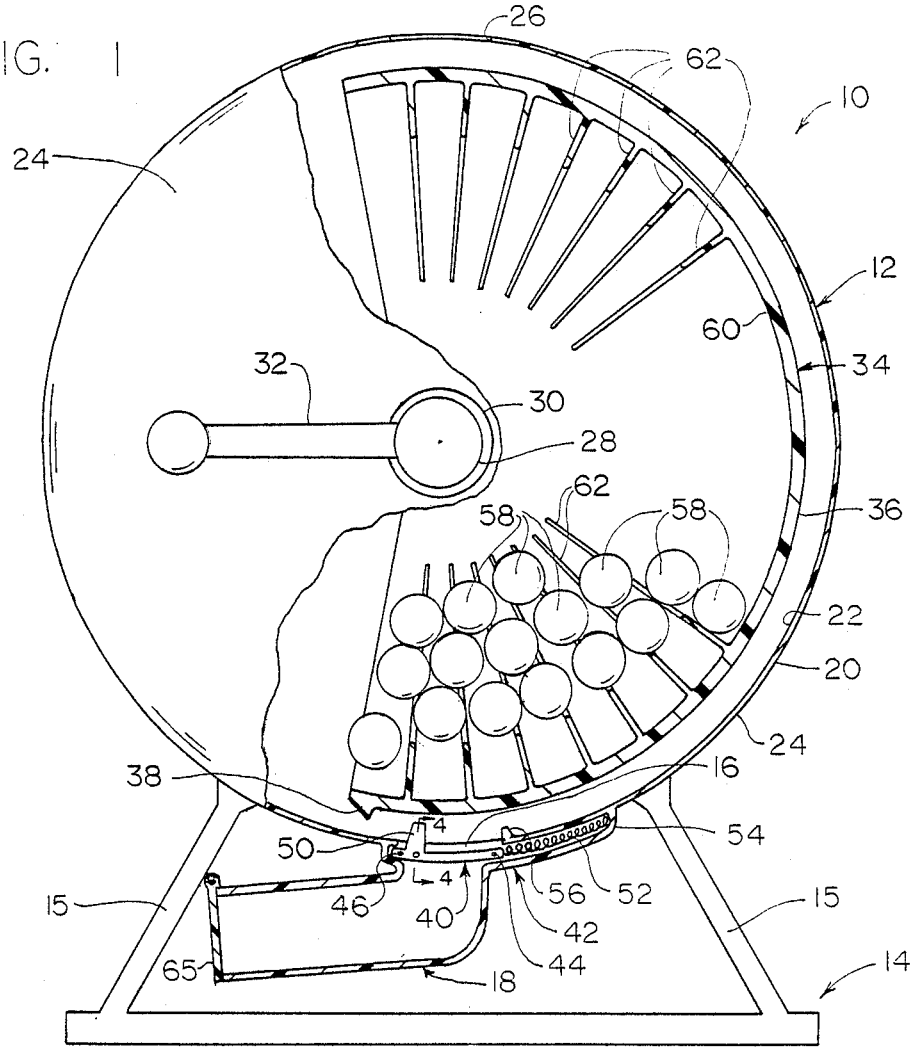
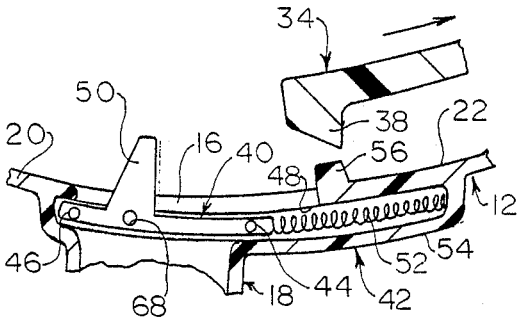
FIG. 3
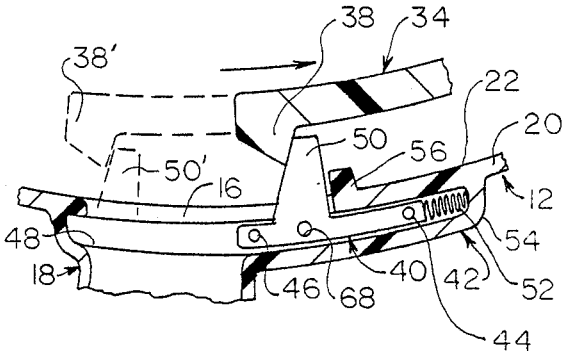
FIG. 2

LOTTERY NUMBER SELECTION DEVICE

BACKGROUND OF THE INVENTION

1. Field of the Invention

The present invention relates to a device for selecting lottery numbers.

2. Description of the Prior Art

In recent years government sponsored lotteries have gained increased public popularity as a means for raising revenue for the general welfare without raising taxes. Lotteries have gained widespread public acceptance in part due to the non-coercive manner of raising revenue, and also due to the hope by lottery participants of being fortunate enough to successfully select lottery numbers in a winning sequence so as to free them from further financial worry.

While various systems exist in different lotteries for selecting winning participants, one widely used system requires a participant to select a predetermined quantity of numbers lying within a specified range of numbers. A winning series of numbers is then selected periodically at random by the lottery system management once the requisite number of lottery tickets have been sold. The winning participants receive large sums of money, typically far in excess of amounts they would otherwise be able to earn. However, only a portion of the proceeds from the sales of lottery tickets are distributed in prizes, as some portion is dedicated to use for the public welfare.

Participants have tried innumerable different systems of selection of lottery number sequences which they each hope will be the winning sequence. For example, participants will frequently select birthdates, ages, telephone numbers, anniversaries and other numbers of particular personal significance in the hope that these will be their "lucky numbers". With time, and after many unsuccessful attempts, many people wish to change their approaches to lottery numbers. With an absence of inspiration for alternative lottery number selection systems, however, many people simply tire of participating. As a consequence, very typically the sales of lottery tickets will be quite large when the lottery system is first introduced, but will steadily deteriorate with waning public interest.

SUMMARY OF THE INVENTION

One important object of the present invention is to provide a lottery number selection device which stimulates and sustains interest in lottery participation. The device of the invention provides an interesting and intriguing means for lottery number selection in which the numbers to be selected are not predictable. Moreover, the lottery selection device of the invention is interesting to observe as well as operate.

In one broad aspect the present invention is an apparatus for selecting lottery numbers comprising a hollow, spherical globe having an outlet tube at its lowest extremity and an access opening in its upper portion. An axle is mounted to extend transversely through the center of the globe and is rotatable relative thereto. A crank handle is connected to the axle and is located externally relative to the globe. An arcuate lottery ball carrier is located within the globe and is joined to the axle to rotate therewith. The carrier defines a radially outwardly projecting tooth. A sliding hatch is mounted on the globe at the lowest extremity thereof and has an upwardly projecting tang that is engageable with the carrier tooth as the carrier rotates within the globe. A means is provided for biasing the hatch to cover the outlet tube. Another means is provided for limiting movement of the hatch in opposition to the biasing means. A multiplicity of lottery balls are inserted into the globe. Each of the lottery balls carries a unique lottery indicia.

As the crank handle is turned the lottery ball carrier revolves about the horizontal axle within the globe, passing closely adjacent to the interior surface of the wall of the globe. Preferably the carrier includes a plurality of radially inwardly projecting vanes which aid in churning the lottery balls within the globe.

At the commencement of rotation of the lottery ball carrier, the sliding hatch may be selectively locked immobile across the lottery ball outlet by some temporary locking mechanism. One suitable form of locking mechanism is a locking pin which is insertable through a structure secured to the globe. The locking pin is directed in a direction parallel to the axle and into engagement with the sliding hatch. The sliding hatch is thus temporarily prevented from moving relative to the globe and is securely held across the lottery ball outlet.

When the crank handle has been turned through several revolutions and the churning vanes on the lottery ball carrier have completely tumbled the lottery balls within the globe, the locking pin may be withdrawn. The tang on the sliding hatch extends radially inwardly within the globe and into the path of travel of the radially outwardly directed tripping tooth. As the carrier passes the sliding hatch, which is located radially outwardly from the carrier, the tripping tooth engages the inwardly projecting tang and pushes the sliding hatch open against the opposition of the biasing means. Once the hatch has been opened, the next lottery ball which tumbles to the lowest extremity of the globe will fall through the lottery ball outlet. The user will thereupon choose the number on the ball as a lottery number selection. Meanwhile, the sliding hatch is limited in its movement in opposition to the biasing means by an obstruction. The lottery ball carrier is sufficiently resilient so that it will deflect radially inwardly to permit the tripping tooth to ride over the top of the tang of the hatch when the hatch has reached its limit of movement. The spring biasing means will thereupon return the hatch to a position completely blocking the lottery ball outlet.

The invention may be described with greater clarity and particularity by reference to the accompanying drawings.

DESCRIPTION OF THE DRAWINGS

FIG. 1 is an elevational view of a device according to the invention, partially in section and broken away.

FIG. 2 is a side elevational detail showing the manner of engagement of the carrier tripping tooth with the latch tang.

FIG. 3 is a side elevational detail showing the relative positions of the latch tang and the tripping tooth following release of the tang.

DESCRIPTION EMBODIMENT

Figure 4:
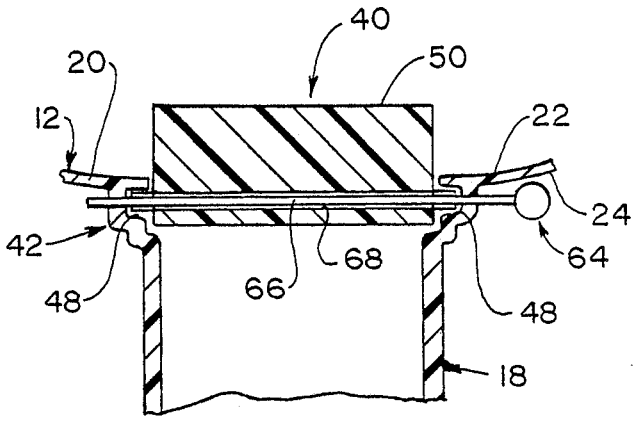
FIG. 4 is a transverse sectional detail taken along the lines 4—4 of FIG. 1.

FIG. 1 illustrates a device 10 for selecting lottery numbers. The device 10 is formed of a hollow, spherical globe 12, preferably fabricated from transparent plastic.

The globe 12 is supported upon a stand 14 by a plurality of laterally spaced legs 15 and has a lottery ball outlet 16 emptying into a downwardly sloping annular lottery ball outlet tube 18. The wall 20 of the globe 12 has a spherical concave inner surface 22 and a spherical convex outer surface 24. A circular lottery ball inlet 26 is defined as an opening in the upper portion of the globe 12, preferably at its uppermost extremity as depicted.

The lottery number selection device 10 also includes an elongated, cylindrical axle 28. The axle 28 is transversely journaled to rotate within annular bearings 30 which are mounted in horizontally aligned, diametrically opposed openings in the wall 20 of the globe 12. The axle 28 extends transversely through the center of the globe 12. A crank handle 32 is joined to the axle 28 perpendicular thereto and is located outside of the globe 12.

Within the globe 12 the axle 28 is joined to an arcuate lottery ball carrier 34. The lottery ball carrier 34 has a spherical curvature of a diameter only slightly smaller than the diameter of curvature of the interior globe wall 22. The carrier 34 is slightly larger than a hemisphere and has a C-shaped cross section when viewed in a section taken perpendicular to the center of the axle 28, as depicted in FIG. 1. The lottery ball carrier 34 is secured to the axle 28 at its horizontal, polar extremities proximate to the bearings 30 at the opposite extremities of the axle 28. The outer surface 36 of the lottery ball carrier is, for the most part, completely smooth and is disposed in close proximity to the structure of the globe 12. That is, the outwardly facing surface 36 of the lottery ball carrier 34 conforms to the curvature of the interior surface 22 of the globe wall 20 and moves in close proximity thereto. At the center of the trailing edge of the lottery ball carrier 34 a generally triangular-shaped tripping tooth 38 is defined to project radially outwardly from the outer surface 36 of the carrier 34 toward the structure of the globe 12.

At the lowest extremity of the globe 12 a curved, generally slab-shaped sliding hatch 40 is mounted within a pocket 42 on the underside of the globe 12. The hatch 40 has two pairs of transversely projecting front and rear guide pins 44 and 46, respectively. The guide pins 44 and 46 extend laterally outwardly into arcuate channel-shaped tracks 48 which are defined in the pocket 42 on both sides of the lottery ball outlet 16. The hatch 40 slides reciprocally relative to the structure of the globe 12 and has an upwardly and inwardly directed, generally trapezoidal-shaped tang 50. The tang 50 projects from the body of the sliding hatch 40 radially toward the axle 28 inwardly into the interior of the globe 12 and into the path of movement of the carrier tripping tooth 38.

The guiding channel-shaped tracks 48 define the path of movement of the laterally projecting guide pins 44 and 46 and restrict the hatch 40 to an arcuate path of movement centered on the axle 28 between a position blocking the lottery ball outlet 16, as depicted in FIGS. 1 and 3, and a position opening the lottery ball outlet 16, as depicted in FIG. 2. Some means, preferably one or more coil springs 52, is disposed in the forward end 54 of the pocket 42 to bias the hatch 40 rearwardly toward the position depicted in FIGS. 1 and 3 to block the lottery ball outlet 16 and to cover the outlet tube 18.

A radially inwardly projecting lip 56 is defined on the interior surface 22 of the wall 20 of the globe 12 at the forward edge of the lottery ball outlet 16. The lip 56 obstructs movement of the hatch 40 against the bias of the spring 44 and limits the extent to which the hatch 40 slides away from the lottery ball outlet 16, as depicted in FIG. 2. The lip 56 limits the extent of movement of the hatch 40 in opposition to the spring 52 when the hatch 40 is moved forwardly and reaches the position opening the lottery ball outlet 16 as depicted in solid lines in FIG. 2.

A multiplicity of small, spherical lottery balls 58 are located within the globe 12 and are movable in a tumbling manner by the carrier 34. Each of the lottery balls 58 bears a unique lottery number indicia, such as a single digit or a two digit number. The lottery balls 58 are introduced into the globe 12 through the opening 26 at the top of the globe 12.

On its interior surface 60 the lottery ball carrier 34 defines a plurality of arcuate vanes 62 extending radially inwardly from the structure of the carrier 34. The vanes 62 are provided for churning the lottery balls 58 so that they tumble over each other and are completely mixed when the crank handle 32 is turned to rotate the carrier 34.

The hatch arcuating mechanism is depicted in detail in FIGS. 2 and 3. In the operation of the lottery number selection device 10, the crank handle 32 is turned in a counterclockwise direction, as viewed in FIG. 1, thereby causing the carrier 34 to likewise rotate in a counterclockwise manner and in a direction indicated by the directional arrows indicated in FIGS. 2 and 3. As the carrier 34 is rotated, the tripping tooth 38 reaches a position indicated in phantom at 34′ in FIG. 2 where it makes contact with and engages the tang, at a position likewise indicated in phantom at 50′. Once the tripping tooth 38 engages the tang 50, it moves the hatch 40 forwardly within the pocket 42 in a counterclockwise arc to a position depicted in solid lines in FIG. 2, thereby opening the lottery ball outlet 16. The tripping tooth 38 moves the hatch 40 in opposition to the spring 52, thereby compressing the spring 52 within the forward end 54 of the pocket 42.

When the hatch 40 is fully opened the tang 50 is brought into abutment against the movement limiting lip 56, as depicted in solid lines in FIG. 2. When the tang 50 meets the limiting lip 56 the hatch 40 will move forward no further. The structure of the carrier 34 is resilient enough to allow the carrier tooth 38 to deflect radially inwardly so that it rides over the top of the tang 50 and passes over the tang 50 when the tang 50 is brought into abutment against the limiting lip 56. Once the radially inwardly deflected tripping tooth 38 clears the tang 50, the spring 52 pushes the hatch 40 rearwardly. The guide pins 44 and 46 ride in the guiding tracks 48 so that the hatch 40 is returned to its original position closing the lottery ball outlet 16, as depicted in FIG. 3. However, before the hatch is released from the open position depicted in FIG. 2, at least one lottery ball 58 will tumble downwardly from the carrier 34 to the lowest extremity of the globe 12 and will pass through the lottery ball outlet 16. The dispensed lottery ball 58 thereupon rolls down the inclined outlet tube 18 were it is inspected for a lottery number indicia by the user.

In order to ensure an adequate opportunity for the lottery balls 58 to be completely mixed by the tumbling action of the carrier 34, a means is provided for selectively immobilizing the hatch 40 in a position blocking the lottery ball outlet 16. This means may take the form of a locking pin 64 having a shank 66 that is insertable through a transverse opening 68 in the hatch 40 beneath the tang 50 and through the structural walls of the guide tracks 48 in the pocket 42 as depicted in FIG. 4. The latching pin 64 is thereby used for the purpose of selectively latching the hatch 40 in the position of FIG. 1 to block the lottery ball outlet 16 and cover the outlet tube 18.

To use the lottery number selection device 10 the lottery balls 58 are first loaded into the interior of the globe 12 through the access opening 26. The latch pin 64 is then inserted into the transverse openings which are aligned parallel to the axle 28 and which extend through the walls of the pocket 42 so that the shank 66 of the latching pin 64 extends completely through the opening 68 in the hatch 40. The crank handle 32 is thereupon turned in a counterclockwise direction. The vanes 62 of the carrier 34 churn and tumble the lottery balls 58 as the carrier 34 is rotated. The hatch 40 is held immobile relative to the globe 12 by the latching pin 64. Although the tang 50 projects into the path of movement of the carrier tooth 38, the carrier 34 will resiliently deflect to allow the tripping tooth 38 to ride up and over the tang 50 as long as the latching pin 64 remains in place.

When the user considers the lottery balls 58 to have been churned sufficiently, the latching pin 64 is withdrawn from the lateral opening 68 in the hatch 40. When this is done, the next time that the tripping tooth 38 is rotated into radial alignment with the tang 50, it will engage the tang 50 as indicated in phantom in FIG. 2 and force it forwardly, thereby fully opening the hatch as depicted in solid lines in FIG. 2. A lottery ball 58 will thereupon drop through the lottery ball opening 16 into the outlet tube 18. When the tang 50 is brought into abutment with the limiting lip 56, the hatch 40 will move forwardly no further. The carrier 34 thereby resiliently yields to allow the tripping tooth 38 to deflect radially inwardly to ride up and over the tang 50. The spring 52 thereupon immediately closes the hatch 40 once the tang 50 has been released. Thereafter, the hatch 40 is reopened with each revolution of the carrier 34, thereby allowing additional lottery balls 58 to drop through the opening 16 to be collected from the outlet tube 18. A chute cover 65 is hinged to the top of the discharge opening of the outlet tube 18 to prevent the lottery balls 58 from indiscriminately falling from the discharge opening. The user merely lifts the chute cover to allow the lottery balls 58 to be discharged.

Undoubtedly, numerous variations and modifications of the invention will become readily apparent to those familiar with lottery number selection devices. For example, while the spring 52 has been illustrated as being compressed, another embodiment might well employ springs maintained in tension and secured to the rear of the opening 16 so as to pull the latch 40 rearwardly when the tang 50 is released by the tripping tooth 38. Also, it is not necessary for the latching pin 64 to extend entirely through the structure of the hatch 40, as it is sufficient if the latching pin merely extends into engagement with the hatch 40. Accordingly, the scope of the invention should not be construed as limited to the specific embodiment of the device depicted and described herein, but rather is defined in the claims appended hereto.

I claim:

1. An apparatus for selecting lottery numbers comprising: a hollow, spherical globe having an outlet tube at its lowest extremity and an access opening in its upper portion, an axle mounted to extend transversely through the center of said globe and rotatable relative thereto, a crank handle connected to said axle and located externally relative to said globe, an arcuate lottery ball carrier located within said globe and joined to said axle to rotate therewith and defining a radially outwardly projecting tooth, a sliding hatch mounted on said globe at the lowest extremity thereof and having an upwardly projecting tang that is engageable by said carrier tooth as said carrier rotates within said globe, means for biasing said hatch to cover said outlet tube, means for limiting movement of said hatch in opposition to said biasing means, and a multiplicity of lottery balls each carrying a unique lottery number indicia located within said globe.

2. An apparatus according to the claim 1 further comprising means for selectively locking said hatch in a position covering said outlet tube.

3. An apparatus according to the claim 1 further comprising a plurality of radially inwardly directed vanes on said carrier for churning said lottery balls.

4. An apparatus according to the claim 1 wherein said tang projects into the path of movement of said carrier tooth, and said carrier tooth engages said tang to move said hatch in opposition to said biasing means, and said carrier is resilient enough to allow said carrier tooth to ride over said tang when said hatch meets said means for limiting movement.

5. In an apparatus for selecting lottery numbers the improvement comprising: a hollow, spherical globe having a lottery ball outlet at its lowest extremity and defining an access inlet in its upper portion, an axle extending transversely through said globe and journaled for rotation relative thereto, an arcuate carrier disposed within said globe in proximity to the structure thereof and carried in rotation by said axle, a tripping tooth projecting radially outwardly from said carrier toward the structure of said globe, a hatch mounted at the lowest extremity of said globe to slide reciprocally relative to the structure thereof to alternatively open and block said lottery ball outlet, a tang projecting from said sliding hatch radially toward said axle and into the path of movement of said tripping tooth, means biasing said sliding hatch to block said lottery ball outlet, means for limiting the extent to which said hatch slides away from said lottery ball outlet, and a multiplicity of lottery balls each bearing a lottery number located within said globe and movable in a tumbling manner by said carrier.

6. An apparatus according to the claim 5 further comprising means for selectively immobilizing said hatch in a position blocking said lottery ball outlet.

7. An apparatus according to the claim 5 further comprising a plurality of vanes extending radially inwardly from said carrier to churn said lottery balls within said globe as said axle rotates.

8. An apparatus according to the claim 5 further comprising guide means on said globe for limiting movement of said hatch to an arcuate path centered on said axle, and said tripping tooth engages said tang to move said hatch to overcome said biasing means, thereby opening said lottery ball outlet and bringing said tang into abutment against said means for limiting movement, and said carrier is resiliently deflectable to allow said tripping tooth to pass over said tang when said tang is brought into abutment against said means for limiting movement.

9. A device for selecting lottery number choices comprising a hollow, spherical globe formed of a wall having inner and outer surfaces and defining a lottery ball outlet in its lowest extremity and a lottery ball inlet in its upper portion, an axle transversely mounted in horizontally aligned openings in said wall of said globe and extending through the center of said globe, a crank handle joined to said axle and located outside of said globe, an arcuate carrier joined to said axle and located within said globe and having a radially outwardly facing surface conforming to the curvature of said globe and located in proximity thereto and having a tooth directed radially outwardly toward said interior surface of said globe wall and having an interiorally facing surface adapted to carry and churn lottery balls, a sliding hatch having a radially inwardly directed tang mounted at the lowest extremity of said globe externally of said wall of said globe with said tang projecting radially inwardly into the interior of said globe and into the path of movement of said carrier tooth when said crank is turned, guide means for limiting movement of said hatch to an arcuate path centered on said axle and between a position blocking said lottery ball outlet and a position opening said lottery ball outlet, spring biasing means urging said hatch toward said position blocking said lottery ball outlet, means obstructing movement of said hatch against the bias of said spring means when said hatch reaches said position opening said lottery ball outlet and a multiplicity of lottery balls each bearing a unique lottery number indicia located within said globe.

10. A device according to the claim 9 wherein said carrier is resilient enough to allow said tooth to deflect radially inwardly to pass over said tang when said hatch reaches said position opening said lottery ball outlet.

11. A device according to the claim 9 further comprising a locking pin insertable through the structure of said guide means to selectively latch said hatch in a position blocking said lottery ball outlet.

12. A device according to the claim 9 wherein said carrier is equipped with a plurality of radially inwardly directed lottery ball churning vanes.

* * * * *